United States Patent [19]

Suga et al.

[11] Patent Number: 4,767,054

[45] Date of Patent: Aug. 30, 1988

[54] APPARATUS FOR CHANGING ARTIFICIAL SNOW TO WET SNOW

[75] Inventors: Nagaichi Suga; Shinichi Katayanagi, both of Tokyo, Japan

[73] Assignee: Suga Test Instruments Co., Ltd., Tokyo, Japan

[21] Appl. No.: 6,082

[22] Filed: Jan. 23, 1987

[51] Int. Cl.[4] ..... A01G 15/00

[52] U.S. Cl. ..... 239/14.2

[58] Field of Search ..... 239/2.1, 2.2, 14.1, 239/14.2

[56] References Cited

U.S. PATENT DOCUMENTS

| | | | |
|---|---|---|---|
| 1,104,920 | 7/1914 | Osborne | 62/74 |
| 3,257,815 | 6/1966 | Brocoff et al. | 62/74 |
| 3,464,625 | 9/1969 | Carlsson | 239/14.2 |
| 3,733,029 | 5/1973 | Eustis et al. | 239/14.2 |
| 3,761,020 | 9/1973 | Tropeano et al. | 239/2.2 |
| 3,945,567 | 3/1976 | Rambach | 239/14.2 |
| 3,952,949 | 4/1976 | Dupre | 239/2.2 |
| 3,964,682 | 6/1976 | Tropeano et al. | 239/14.2 |
| 4,200,228 | 4/1980 | Woerpel | 239/2.2 |

*Primary Examiner*—Andres Kashnikow
*Assistant Examiner*—Karen B. Merritt
*Attorney, Agent, or Firm*—Wenderoth, Lind & Ponack

[57] ABSTRACT

An artificial snow making apparatus has a vertical inner cylinder, an outer tank around said inner cylinder, an air velocity adjusting duct connected between the top and an intermediate portion of the inner cylinder for causing air to flow therethrough from the top of the inner cylinder and to flow upwardly in the inner cylinder. The duct has a fan therein for adjusting the velocity of the air flowing therethrough for thereby adjusting the velocity of the air flowing in the inner cylinder. A cloud making machine and a seeding device are connected directly to the vertical inner cylinder at positions between the top and the intermediate portion. A cooling unit is provided for cooling air in the outer tank, thereby cooling the inner cylinder. A blower apparatus draws air from the outer tank, adjusts the temperature to the temperature of the air inside the inner cylinder and directs it downwardly into the inner cylinder below the intermediate portion. A temperature/humidity control apparatus draws air from the outer tank, adjusts the temperature and humidity thereof to a temperature and humidity higher than the temperature and humidity of the air in the upper part of the inner cylinder, and directs it downwardly into the inner cylinder at a position below the position of the blower apparatus.

11 Claims, 1 Drawing Sheet

APPARATUS FOR CHANGING ARTIFICIAL SNOW TO WET SNOW

BACKGROUND OF THE INVENTION

This invention relates to an apparatus for changing artificial snow made by an artificial snow making apparatus to wet snow in order to conduct a snow settling test.

One conventional artificial snow making machine is disclosed, for example, in Japanese Patent Laid-Open No. 165,566/1986.

This prior art technique will be described with reference to FIG. 2 of the accompanying drawings. This apparatus comprises a vertical cooling tower 4, a snowfall chamber 1 connected to the bottom of cooling tower 4 and having an opening 3 at the ceiling thereof and which is covered by the cooling tower 4, a first cooler 9 for cooling the air inside the cooling tower 4, and inner cylinder 12 disposed inside the cooling tower 4 in such a manner as to extend in the longitudinal direction of the cooling tower 4 and having an opening at the bottom thereof which is communicated with the opening 3 of the snowfall collection chamber 1, a circulation pipe 13 communicating the top and lower end of the inner cylinder 12, a variable speed blower 14 disposed at an intermediate portion of the circulation pipe 13, a humidifier 15 for supplying moisture into the inner cylinder 12 in the proximity of the lower end of the inner cylinder 12 and a snow seed feeder for supplying ice crystals into the inner cylinder in the proximity of the humidifier 15.

No apparatus is known in the art which changes the snowfall obtained by such an artificial snow making apparatus to wet snow.

A snow-covered power transmission line undergoes torsion in winter and is broken from time to time. This problem occurs particularly when the snow is wet snow.

A snow settling test can be conducted at the time of a natural snowfall in winter but wet snow is not always obtained at the time of natural snowfall. Even in Hokkaido which is the northernmost part of Japan, a wet snowfall may be observed only once a winter or not at all. Therefore, the snow settling test is carried out by sieving the outdoor snow to granular snow, blowing a mist of 0° C. onto the snow to wet it and causing the snow to impinge against the sample (cable) inside an air channel for snow settlement.

The problem here is that the properties of the snow in the snow settling test are entirely different from those of the natural wet snow, though the test uses the natural snow, and a reliable correlation cannot be established between them so that the snow settling test cannot be carried out accurately.

Accordingly, there is a strong demand for an apparatus for changing the artificial snow to wet snow which can provide wet snow having properties almost equivalent to those of the natural wet snow and which can immediately supply the wet snow thus obtained to the snow settling test.

The snow made by the above-described conventional artificial snow making apparatus has the same crystal form as that of the natural snow, but since the former is produced at a low temperature in the range of from about −5° C. to −15° C., its water content is low.

When formed high up in the sky, natural snow becomes wet snow if the temperature on the ground is about 0° C. Therefore, it is possible to change the artificial snow formed in the artificial snow making apparatus and falling thereinside to wet snow by raising the temperature.

If the temperature of the snowfall chamber (test chamber) disposed at a lower part of the artificial snow making apparatus is raised in order to obtain the wet snow, however, the air in the snowfall chamber rises due to convection and the air having a negative temperature inside the inner cylinder 12 drops so that the ice crystals that have not yet grown to snowfall and the snow cannot turn to the wet snow.

For this reason, too, there is a strong demand for the development of an apparatus for changing the snow obtained from the artificial snow making apparatus to wet snow in order to carry out the snow settling test.

SUMMARY OF THE INVENTION

In order to satisfy the requirements described above, the present invention provides an apparatus for changing the artificial snow to wet snow by disposing a blower and a temperature/humidity control means inside a vertical inner cylinder for growing the snow of the artificial snow making machine to prevent the convection between the upper air and the warm and wet air inside the inner cylinder and to change the snow falling down inside the inner cylinder to wet snow, and the apparatus of the invention can thus make it possible to carry out the snow settling test at any arbitrary time throughout the year.

To eliminate the problems with the prior art described above, the present invention employs the following means.

In an artificial snow making apparatus of the type shown in FIG. 2 and which consists of a cloud making machine 31 and a seeding device 32 that are directly connected to a vertical inner cylinder 30, an air velocity adjusting duct 33 for adjusting the velocity of the air inside the inner cylinder and a cooling unit 35 disposed inside an outer tank 34 for cooling the inner cylinder, the apparatus for changing the artificial snow to wet snow according to the present invention is characterized in that a blower and a temperature/humidity control means are disposed below an air to blow port of an air velocity adjusting duct of a vertical inner cylinder for growing the snow, the blower sucks in the air, adjusts it to a temperature equal to that of the air inside the inner cylinder an sends it into the inner cylinder as a descending current and the temperature/humidity control means sucks in the air, adjusts it to a temperature and a humidity that are suitably higher than those of the air at the upper part of the temperature/humidity control means and sends it into the inner cylinder as a descending current, in order to prevent convection between the upper air inside the inner cylinder and the hot and wet air and to change the snow descending inside the inner cylinder to the wet snow.

In the present invention having the construction described above, the temperature/humidity control means exhibits the function of wetting the snowfall, the temperature/humidity supply means adjusts the temperature and humidity of the air sucked in by a blast fan to the temperature and humidity suitably higher than those of the air at the upper part of the temperature/humidity control means and the temperature/humidity control means charges this air into the inner cylinder. The temperature and humidity supplied hereby are controlled by a temperature/humidity controller and the supply quantity is controlled suitably by controlling the number of revolutions of a motor of a blast fan.

When the hot and wet air is supplied into the inner cylinder by the means described above, however, the air rises due to convection.

To prevent convection, a blower is disposed above the temperature/humidity control means to send the air downward into the inner cylinder and to prevent convection of the hot and wet air supplied by the temperature/humidity control means.

In other words, the air sent into the inner cylinder is sucked by a blast fan and its temperature is adjusted by a heater to a level equal to a snow making temperature (e.g. −15° C.) at that time.

The blast velocity at this time is adjusted by controlling the number of revolution of a motor of a blast fan by a fan controller.

In this case, the blast velocity is adjusted to the level that withstands the convection between the ascending current for snow making and the supply temperature and humidity for wetting the snow.

In this manner, the convection between the upper air of the blower inside the inner cylinder and the warm and wet air is prevented and the snow descending inside the inner cylinder is wetted. The wetted snow is introduced into a test chamber for a snow settling test in order to clarify the settlement of the snow on the power transmission line, to develop a prevention method and covering materials, and so forth.

DESCRIPTION OF THE PREFERRED EMBODIMENT

Figure 2:
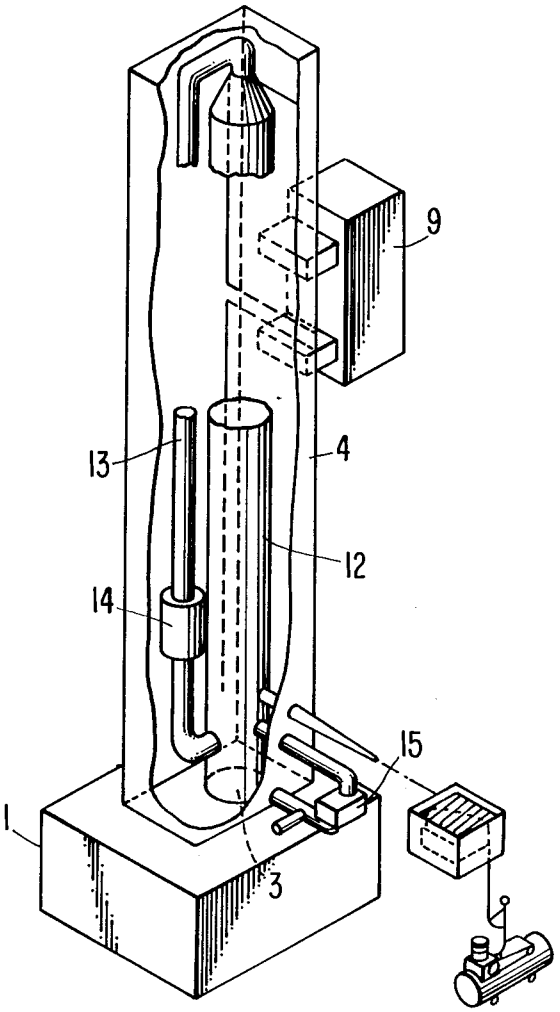
FIG. 2. (PRIOR ART)
FIG. 2 is a partially cut-away perspective view of an artificial snow making apparatus in accordance with the prior art.
Figure 1:
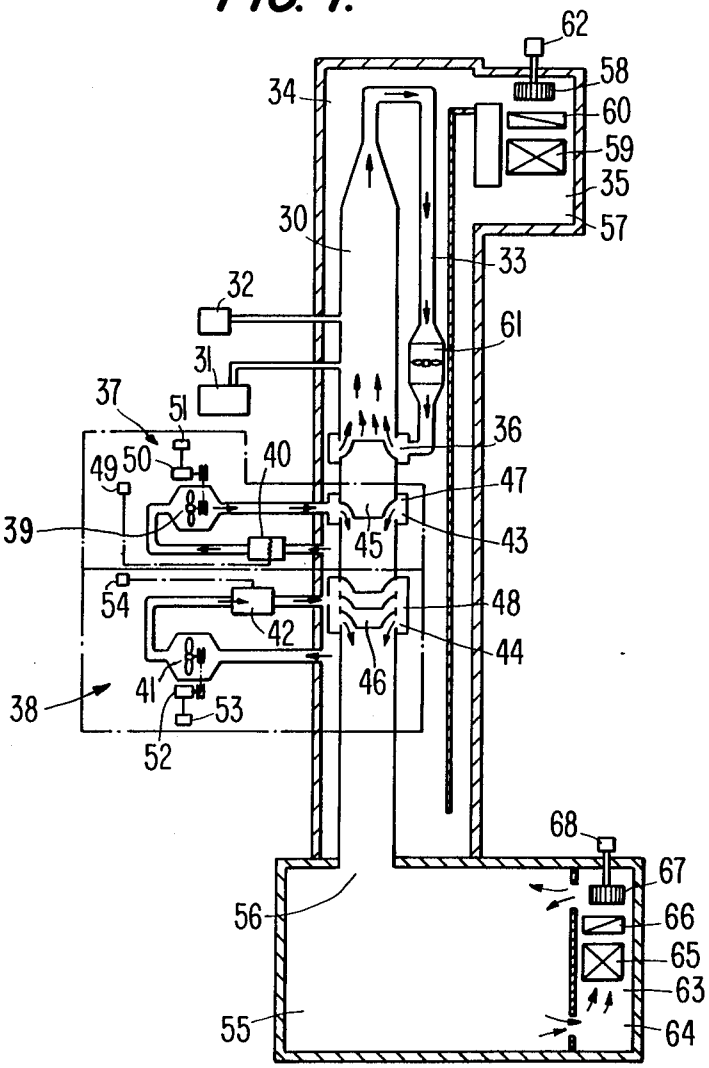
FIG. 1 is a longitudinal sectional front view of an apparatus for changing artificial snow to wet snow in accordance with the present invention.

Hereinafter, a preferred embodiment of the present invention will be described in detail with reference to FIG. 1.

First of all, the apparatus for changing the artificial snow to wet snow has the following construction.

An inner cylinder 30 mounted upright over an opening 56 of a test chamber 55 is surrounded by an outer vessel 34, air inside this outer vessel 34 is circulated by a circulating fan 58 is a temperature control chamber 57 of the cooling unit 35 and its temperature is controlled by a cooler 59 and a heater 60.

The air inside the inner cylinder 30 is circulated by a blower 61 from the upper part of the inner cylinder 30 through an air velocity adjusting duct 33 and an ascending current is applied to the air inside the inner cylinder.

The temperature inside the inner cylinder 30 is indirectly controlled by adjusting the temperature of the air inside the outer vessel 34 around the outer circumference of the inner cylinder 30 and is within the range of from about −5° C. to about −20° C.

A cloud making machine 31 is connected to the interior of the inner cylinder 30 to supply a cloud (vapor) into the inner cylinder.

A seeding device 32 is connected to the interior of the inner cylinder 30 to supply seed as the nuclei of the snow into the inner cylinder.

In the apparatus described above, the cloud and the snow from the snow seed are formed inside the inner cylinder 30 which is cooled to −15° C., for example. Here, if the speed of the ascending current is reduced, the snow grains become small and if the speed is increased, on the other hand, the snow grows to large snow grains with a weight sufficient to fall against the ascending current.

In the artificial snow making apparatus described above, a blower means 37 is disposed below the air blow port 36 of an air velocity adjusting duct 33 for adjusting the velocity of the internal air in the vertical inner cylinder 30 for growing the snow. A blast fan 39 of the blower means 37 sucks the cooling air around the outer circumference of the inner cylinder, for example, sends the warm air adjusted to a temperature equal to the air temperature inside the inner cylinder by a heater 40 to a blade guide 47, charges the warm air into the inner cylinder through a plurality of air vents 43 bored around the circumference of the inner cylinder 30 and provides a descending current by an air direction plate 45 disposed inside the inner cylinder 30.

The blast velocity is adjusted by controlling the speed of a motor 50 of the blast fan 39 by a fan controller 51. In this case, the blast velocity is adjusted to the ascending current for forming the snow and the velocity which withstands the convection due to the supply temperature and humidity for wetting the snow.

The temperature of the heater 40 is controlled by a temperature controller 49.

The blower means 37 is disposed above the temperature/humidity control means 38 and sends the air downwards into the inner cylinder, thereby preventing the convection of the warm and wet air supplied from the temperature/humidity control means 38.

The temperature/humidity control means 38 is disposed below the blower means 37. Its blast fan 41 draws in the cooling air around the outer circumference of the inner cylinder 30, for example, and temperature/humidity supply means 42 adjusts the temperature and humidity of the air and sends the air to a temperature/humidity controlled air supply manifold 48. The air is then sent into the inner cylinder through a plurality of air vents 44 bored around the circumference of the inner cylinder 30 and the warm and wet air is caused to flow downward by the blast direction plate 46 disposed inside the inner cylinder 30.

The temperature and humidity hereby supplied are controlled by the temperature/humidity controller 54 and the quantity is adjusted by controlling the speed of the motor 52 of the blast fan 41 so that an optimum quantity is supplied.

Although a plurality of air vents 44 and blast direction plates 46 are disposed on the manifold 48 of the temperature/humidity control means 38, they are not limitative, in particular. In short, any arrangement may be employed so long as air having a predetermined temperature and humidity can be secured.

In the drawings, reference numeral 62 represents a fan motor for rotating the circulation fan 58 of the cooling unit 35 and reference numeral 63 represents a cooling unit disposed in the test chamber 55. The cooling unit 63 includes a temperature adjusting chamber 64, a cooler 65, a heater 66, a circulation fan 67 and a fan motor 68.

In the present invention having the construction described above, air from the blower and the temperature/humidity control means is directed inside the vertical inner cylinder for growing the snow of the artificial snow making apparatus so that the convection between the upper air inside the inner cylinder and the air of the temperature chamber is prevented and the snow that descends inside the inner cylinder is wetted and then introduced into the test chamber. Therefore, the snow settling test can be made arbitrarily at any time throughout the year.

Since the snow wetted in accordance with the present invention has the same properties as those of natural wet snow, it has a close correlation with the natural wet snow and the snow settling test can be made accurately.

Accordingly, the present invention contributes greatly to the clarification of the settling of the snow on a power transmission line, the development of a method of preventing the settlement of the snow and the development of covering materials for the cable. The present invention can also be used for clarifying the settlement of the snow and preventing the snow damage on roof materials, airplanes, cars, and so forth.

What is claimed is:

1. An artificial snow making apparatus including means for changing artificial snow generated therein to wet snow, comprising:

a vertical inner cylinder;

an outer tank around said inner cylinder;

an air velocity adjusting duct means connected between the top of said inner cylinder and an intermediate portion of said inner cylinder for causing air to flow from the top of said inner cylinder to said intermediate portion and to flow upwardly in said inner cylinder, said duct means including means therein for adjusting the velocity of the air flowing therethrough for thereby adjusting the velocity of the air flowing in said inner cylinder;

a cloud making machine and a seeding device connected directly to said vertical inner cylinder at positions between the top and said intermediate portion thereof;

a cooling unit disposed inside said outer tank for cooling air in said outer tank for cooling said inner cylinder;

a blower means connected to said outer tank for drawing air from said outer tank and adjusting the temperature thereof to the temperature of the air inside said inner cylinder and directing it downwardly into said inner cylinder below the intermediate portion thereof at which said duct means is connected to said inner cylinder;

a temperature/humidity control means connected to said outer tank for drawing air from said outer tank and adjusting the temperature and humidity thereof to a temperature and humidity higher than the temperature and humidity of the air in the upper part of said inner cylinder and directing it downwardly into said inner cylinder at a position below the position at which said blower means directs air into said inner cylinder, whereby convection is prevented between the air from said temperature/humidity control means and the air in the upper part of said inner cylinder and snow generated in said inner cylinder is changed to wet snow as it descends in said inner cylinder.

2. An apparatus as claimed in claim 1 in which said blower means includes a blast guide mounted around said inner cylinder through which the air from said blower means is directed into said inner cylinder.

3. An apparatus as claimed in claim 1 in which said temperature/humidity control means includes an air supply manifold mounted around said inner cylinder through which air from said temperature/humidity control means is directed into said inner cylinder.

4. An apparatus as claimed in claim 1 in which said blower means includes a blast fan for drawing air from said inner cylinder, a heater for adjusting the temperature of the thus drawn air, and a blast guide around said inner cylinder to which the outlet of said blast fan is connected for directing the thus heated air into said inner cylinder.

5. An apparatus as claimed in claim 1 in which said temperature/humidity control means comprises a further blast fan for drawing air from said inner cylinder, means for adjusting the temperature and humidity of the thus drawn air, and an air supply manifold around said inner cylinder to which the outlet of said further blast fan is connected for directing the temperature and humidity adjusted air into said inner cylinder.

6. An apparatus as claimed in claim 1 in which said inner cylinder has a plurality of air vents therein to which said blower is connected for supplying the temperature adjusted air into said inner cylinder.

7. An apparatus as claimed in claim 1 in which said inner cylinder has a further plurality of further air vents therein to which said temperature/humidity control means is connected for supplying the temperature and humidity adjusted air into said inner cylinder.

8. An apparatus as claimed in claim 1 in which said blower means includes air direction plates positioned in said inner cylinder for directing the temperature adjusted air downwardly in said inner cylinder.

9. An apparatus as claimed in claim 1 in which said temperature/humidity control means includes further air direction plates positioned in said inner cylinder for directing the temperature and humidity adjusted air downwardly in said inner cylinder.

10. An apparatus as claimed in claim 1 in which said blower means comprises a heater, a temperature controller connected to said heater for said motor, a blast fan, a motor driving said blast fan, a motor speed controller, a blast guide mounted around said inner cylinder, and an air direction plate within said inner cylinder, said inner cylinder having air inlets therein between said blast guide and said air direction plate.

11. An apparatus as claimed in claim 1 in which said temperature/humidity control means comprises a further blast fan, a further motor driving said further blast fan, a further motor speed controller for said further motor, a temperature/humidity means for adjusting the temperature and humidity of the drawn in air, an air supply manifold mounted around said inner cylinder, and an a further air direction plate within said inner cylinder, said inner cylinder having further air vents between said air supply manifold and said further air direction plate.

* * * * *